US005601007A

United States Patent [19]

Clough et al.

[11] Patent Number: 5,601,007

[45] Date of Patent: Feb. 11, 1997

[54] MEDIA TABBING APPARATUS AND METHOD

[75] Inventors: Arthur H. Clough, Hardwick; Matthew D. Guzzetta, Tewksbury, both of Mass.

[73] Assignee: Polaroid Corporation, Cambridge, Mass.

[21] Appl. No.: 343,224

[22] Filed: Nov. 22, 1994

[51] Int. Cl.[6] ..... B26D 3/08

[52] U.S. Cl. ..... 83/887; 83/879; 83/886; 83/165; 83/419; 83/487; 83/488; 83/578; 83/614

[58] Field of Search ..... 83/879, 861, 886, 83/614, 578, 485, 487, 488, 489, 418, 419, 436, 165, 880, 887

[56] References Cited

U.S. PATENT DOCUMENTS

| | | | |
|---|---|---|---|
| 1,746,284 | 2/1930 | Robinson et al. | 83/879 |
| 2,171,769 | 9/1939 | Stolar et al. | 164/84.5 |
| 2,324,950 | 7/1943 | Pratt | 83/165 |
| 2,878,868 | 3/1959 | Brandt et al. | 83/436 |
| 2,969,930 | 1/1961 | Zernov | 83/487 |
| 3,122,040 | 2/1964 | Bishop | 83/94 |
| 3,165,951 | 1/1965 | Lindquist | 83/12 |
| 3,221,585 | 12/1965 | Staar | 83/614 |
| 3,236,129 | 2/1966 | Bishop | 83/6 |
| 3,240,089 | 3/1966 | Chamberlain et al. | 83/1 |
| 3,459,078 | 8/1969 | Black | 83/8 |
| 3,555,950 | 1/1971 | Gijsbers et al. | 83/171 |
| 3,673,953 | 7/1972 | Massari | 101/19 |
| 3,875,834 | 8/1975 | Vulcano | 83/861 |
| 3,909,582 | 9/1975 | Bowen | 219/121 LM |
| 3,965,786 | 6/1976 | D'Luhy | 83/346 |
| 3,981,215 | 9/1976 | Granger et al. | 83/485 |
| 4,401,001 | 8/1983 | Gerber et al. | 83/451 |
| 4,448,101 | 5/1984 | Templeton | 83/489 |
| 4,494,435 | 1/1985 | Lindsay | 83/880 |
| 4,516,461 | 5/1985 | Schaeffer | 83/881 |
| 4,517,872 | 5/1985 | Dontscheff | 85/880 |
| 4,517,873 | 5/1985 | Wilson | 83/881 |
| 4,519,285 | 5/1985 | Dontscheff | 83/880 |
| 4,596,541 | 6/1986 | Ward, Sr. et al. | 493/59 |
| 4,608,891 | 9/1986 | Frisby et al. | 83/56 |
| 4,625,611 | 12/1986 | Baumann | 83/861 |
| 4,674,503 | 6/1987 | Peyman et al. | 128/305 |
| 4,754,674 | 7/1988 | Perlman | 83/436 |
| 4,921,563 | 5/1990 | Schwertner | 156/303.1 |
| 4,949,609 | 8/1990 | Sohtome et al. | 83/418 |
| 5,160,573 | 11/1992 | Takagi et al. | 156/510 |
| 5,220,858 | 6/1993 | Allen et al. | 83/880 |
| 5,307,716 | 5/1994 | Onishi et al. | 83/614 |

*Primary Examiner*—Eugenia Jones
*Assistant Examiner*—Charles Goodman
*Attorney, Agent, or Firm*—Leslie Payne

[57] ABSTRACT

An apparatus for forming a tab portion on a thin laminated sheet having work stations for scoring the sheet on a forward edge along a line to form the tab portion. The tabbing station includes a shuttle member having a pair of spaced rollers, one with a cutting edge and the other being a backing roller. The edge to be scored is passed between the rollers, such that the cutting roller as it traverses the length scores the sheet by a controlled amount which is determined by the preselected spacing between the cutting edge and the backing roller, whereby the unscored portion remains the same thickness regardless of the thickness variations of the sheet.

11 Claims, 10 Drawing Sheets

MEDIA TABBING APPARATUS AND METHOD

BACKGROUND OF THE INVENTION

This invention relates generally to a method of and apparatus for cutting sheet material and, in particular, to a method of and apparatus for precisely scoring a portion of a laminar imaging media in order to create a tab for facilitating media delamination.

Laminar imaging media, such as thermographic print media are used in the formation of images. Thermographic materials have images formed thereon in response to laser energy being applied thereto. This print media is a relatively thin laminate comprising essentially a substrate, an overlying disposable peelable sheet, and an intermediate multicomponent image forming layer including adhesives joining the substrate and peel sheet. After the application of laser energy for forming an image on the media, the peel sheet is peeled relative to the substrate for effecting a desired delamination. As a consequence of such peeling, the desired image remains on the substrate. Until peeling, however, it is important that the laminate remain intact. Because of the requirement that the media be peeled and because the material is relatively difficult to handle for a number of reasons, the substrate is formed with a frangible tab portion formed along a score line adjacent a marginal edge of the media. The tab portion is designed to break or snap along the score line upon the application of forces thereto in order to initiate such separation of the peel sheet from the substrate. The thermographic film is normally provided with such a tab in its fabrication process. However for some imaging applications, it is desirable that the film not be imaged with a tab portion. Therefore, there is a requirement that a tab portion for facilitating delamination be formed following the imaging step. Scoring of the sheet material is common practice and typically involves use of a cutting implement which traverses the material, for example along a marginal edge of sheet material. Some of the scoring or cutting techniques include the controlled penetration of a layer of a laminate.

Exemplary of known scoring or cutting apparatus of the last noted type are described in the following U.S. Pat. Nos.: 3,165,951; 3,909,582; 4,516,461; 4,517,872; 4,519,285; and, 5,220,858. However, there is a continuing desire to improve on apparatus and methods for reliably and simply scoring imaging media in a manner which insures a controlled depth of cut regardless of thickness variations of imaging media sheet, and in a manner which does not damage the imaging media being handled.

SUMMARY OF THE INVENTION

In accordance with the present invention, there is provided an improved apparatus for scoring a sheet material and, in particular, forming a tab at a marginal edge of a thin laminated sheet of dry peel-apart media.

The apparatus comprises a housing assembly; a carriage assembly that is movably mounted on the housing assembly and reciprocating operable for movement along a travel path. A cutting roller assembly is mounted on the carriage assembly and has at least a rotatable cutting edge disposed for cutting across one surface of the sheet as it travels along a cutting path so as to make a preselected cut. Provision is made for a supporting roller assembly rotatably mounted on the carriage assembly adjacent the cutting assembly and having a surface for movement across an opposite surface of a sheet when the carriage assembly is moved along the travel path. The cutting edge is disposed at a predetermined distance from the supporting roller assembly surface for defining a cutting depth control system for the sheet, such that uncut portions of the sheet have the same dimension regardless of the sheet thickness being cut. There is provided means disposed on the frame assembly for frictionally engaging one surface of the sheet and for retaining the sheet in contact with the supporting roller assembly during movement of the carriage assembly along the travel path. The cutting roller assembly has a bearing surface disposed thereon, and the supporting roller assembly has a bearing surface disposed thereon. The bearing surfaces are in contact one with the other during movement of the carriage assembly along the travel path. There is also provided means for moving the carriage assembly along the travel path, whereby at least one sheet of a laminated media is cut by the cutting roller assembly, wherein the cutting roller assembly and the supporting roller assembly are rotatable during movement of the carriage assembly in response to contact between the support roller assembly and the friction means.

In an illustrated embodiment, the carriage assembly includes a shuttle which is movable along a path substantially parallel to the marginal edge of the sheet. The cutting roller assembly is rotatably mounted on the shuttle and has a cutting edge disposed for movement across one surface of the sheet when the shuttle is moved along its path. The supporting roller is a backing roller rotatably mounted on the shuttle adjacent the cutting roller assembly and has a surface for movement across the opposite surface of the sheet when the shuttle is moved along the shuttle path. Friction means are provided for contacting one surface of the sheet and retaining the sheet in contact with the backing roller during movement of the shuttle along the shuttle path. The cutter roller assembly has a bearing surface disposed for contacting a bearing surface of the backing roller during movement of the shuttle along the shuttle path.

The apparatus may also include a pair of in-feed rollers disposed for receiving the sheet's marginal edge therebetween and feeding the sheet to a position in the path of the shuttle. The apparatus may also include means for alignment of the marginal edge of the sheet with the path of the shuttle. The alignment means include a pair of in-feed rollers for receiving the sheet's marginal edge therebetween and feeding it to a position in the path of the shuttle. Means may also the provided for sensing the marginal edge of the sheet and rotating the in-feed rollers to move the marginal edge of the sheet a predetermined distance past the path of the shuttle bar to determine the length of tab to be formed by the apparatus.

Among the other objects of the present invention are, therefore, provisions of method and apparatus which precisely score laminated film media, such that the unscored layers retain the same thickness regardless of the dimensions of the laminate; provisions of method and apparatus which simply, reliably and economically permit the scoring of media of different widths; and, provisions of method and apparatus which effect such scoring in a self-contained manner without damaging the media; and, provisions of method and apparatus which reduce the effects of cumulative tolerances.

Reference is made to the accompanying drawings in which there is shown a preferred illustrative embodiment of the invention from which its novel and unobvious features and advantages will be apparent, wherein like reference numerals indicate like structure throughout the several views.

DETAILED DESCRIPTION

Figure 1:
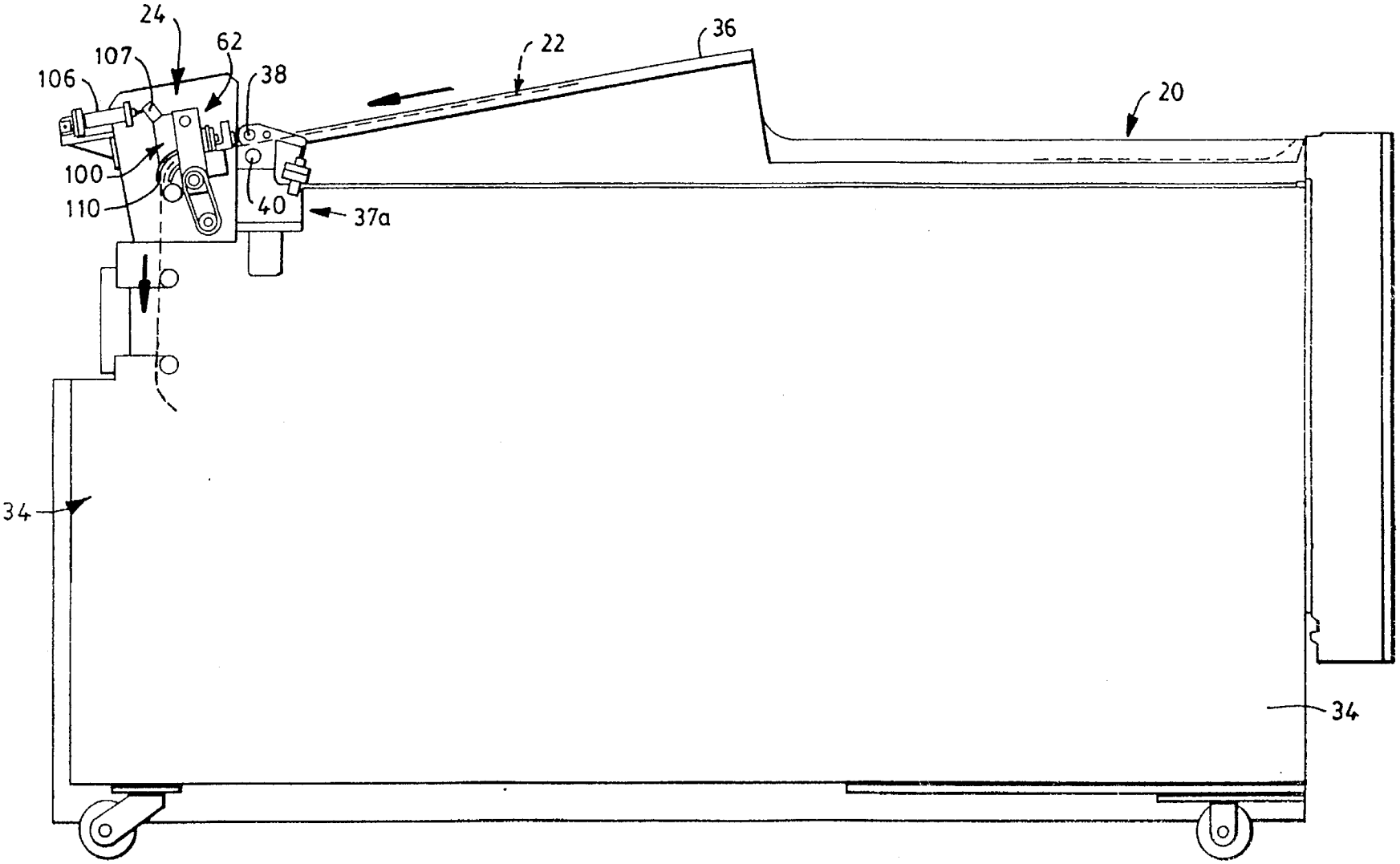
FIG. 1 is an elevational schematic view showing a self-contained apparatus for the processing of a thin laminated sheet in which the apparatus of the present invention is incorporated.
Figure 2:
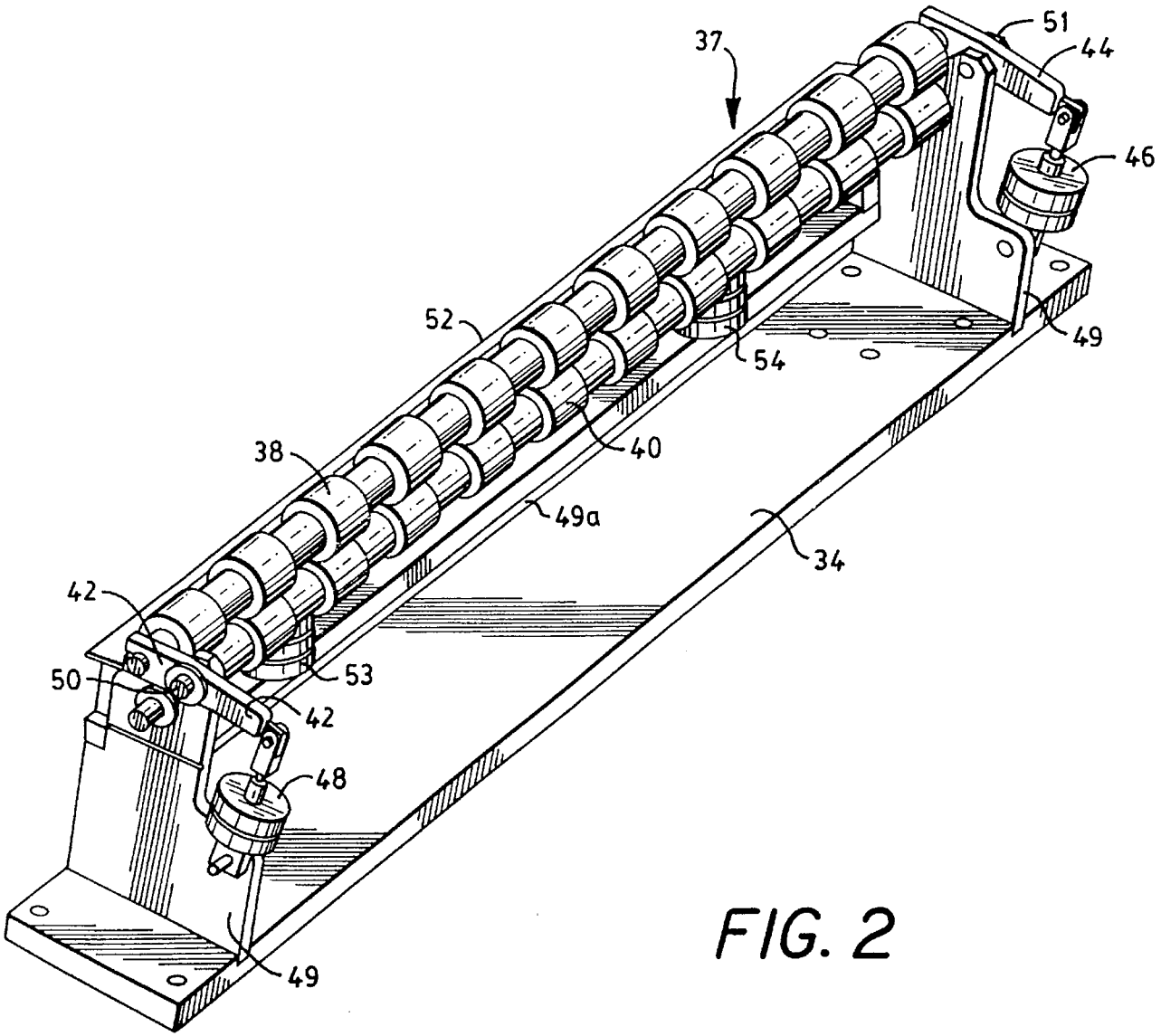
FIG. 2 is a top perspective view showing an in-feed device employed in the apparatus of FIG. 1.

Referring to the drawings and, in particular, to FIG. 1, a processing apparatus 20 is depicted for processing a sheet of laminar imaging film media 22. The processing apparatus 20 includes a tabbing apparatus 24 which is operable for forming a tab portion 26 (FIG. 11) along a marginal edge of the imaging medium 22. The processing apparatus 20 includes other modules or components (not shown) for peeling and laminating the tabbed film sheet, which modules do not form an aspect of the present invention. The other apparatus and modules as well as the peeling functions are described more specifically in copending and commonly assigned U.S. patent application Ser. No. 08/358,343 entitled "METHOD OF AND APPARATUS FOR DELAMINATING MEDIA" filed Dec. 19, 1994. The tab portion 26, as will be described, is used for initiating a peeling separation of the laminate following exposure. In some imaging situations, there is a requirement that a tab not be preformed on the film sheet because they otherwise lose images at the edges of a sheet. The present embodiment can form such a tab on a variety of material including a dry, peel-apart laminate imaging media including thermographic media, such as the general kind described in International Application PCT/US published Jun. 16, 1988 under International Publication No. WO 88/04237. Other dry imaging media laminates can be tabbed in accordance with the present invention and, therefore, the tabbing aspects of the present invention are not limited to the specific type of dry imaging media described above or for that matter other laminated material.

Figure 11:
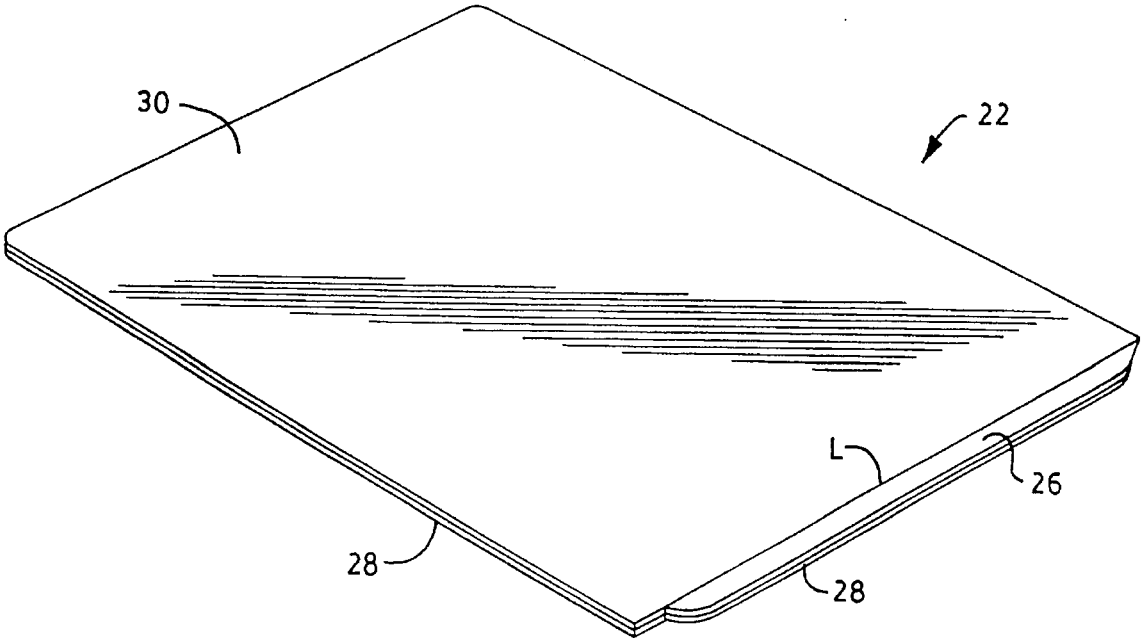
FIG. 11 is a perspective view of a thermographic imaging film material having a tab portion formed thereon.
Figure 12:
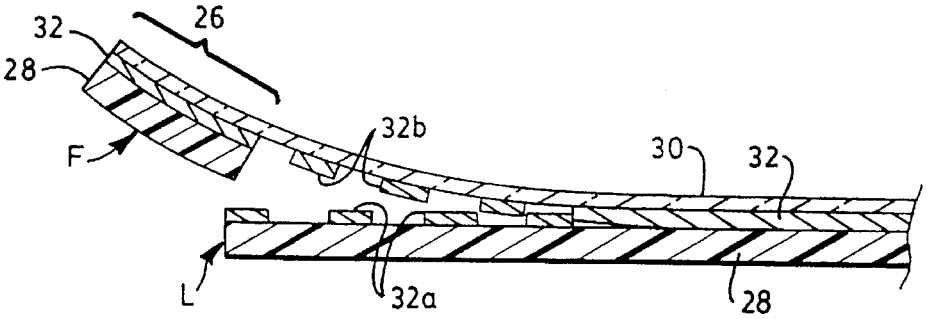
FIG. 12 is a fragmented side sectional view of the imaging film of FIG. 11 in the process of peeling; and, FIG. 13 is a schematic representation of the cutting control mechanism of the present invention.

Reference is made to FIGS. 11 and 12 for illustrating one embodiment of a sheet of the imaging film media 22. The film media 22 is a relatively thin laminate comprising essentially a substrate or "keeper sheet" 28, an overlying disposable peelable, "throwaway or peel sheet" 30, and an intermediate multicomponent image forming layer 32 including adhesives joining the keeper and peel sheets. After the application of laser energy, preselected portions 32*a* remain on the keeper sheet 28 and other portions 32*b* are removed for forming an image, the peel sheet 30 is peeled relative to the substrate 28 for effecting a desired delamination which yields the desired image. The tab 26 can be formed in the peel sheet. For illustrative purposes, the peel sheet can have a thickness of about 1 mil and the keeper sheet can have a thickness of about 4 mil. Other thicknesses can of course be handled by the tabber of the present invention.

Referring now to FIGS. 1–4, the tabber apparatus 24 is mounted on a frame assembly 34. The frame assembly 34 includes an inclined and generally planar feed table 36 upon which an operator can feed individual sheets to the tabber apparatus. The tabber apparatus 24 includes an in-feed assembly 37 which comprises a pair of in-feed roller assemblies 38 and 40 into which the film media 22 in sheet form is fed by the operator of the apparatus 20. The bottom roller assembly 40 is connected by a rotatable shaft 41 to drive means (not shown) which may be of any type well-known in the art. The top roller assembly 38 has a mounting shaft which is connected at opposite ends to pivoting arms 42 and 44 and is rotatable in response to being driven by the lower roller assembly. The arms 42, 44 are connected at their distal ends to one end of a plunger of the fluid activated cylinders. The arms 42, 44 are pivotally attached to a pair of upstanding and spaced apart frame members 49 by pivot pins 50 and 51; respectively. Thus, the top roller assembly is pivotally movable relative to the lower assembly for establishing a drive nip for driving the film sheet towards the tabber apparatus. The top roller assembly is connected by arms 42 and 44 to a pair of fluid activated cylinders—46 and 48; the arms being pivotally attached to the frame members 49 by pins 50 and 51.

A film sheet de-skewing means includes a de-skewing plate 52 which extends along a portion of the length of the rollers so that a plurality of sheets can de-skewed and subsequently tabbed. The plate 52 is movable upwardly and downwardly by a pair of fluid actuating cylinders 53 and 54 which, in turn, are resting on a horizontal frame bar 49*a*. The de-skewing plate 52 is provided with a plurality of linearly spaced apart and upwardly projecting stop tabs 56. The tabs 56 are movable upwardly, or downwardly relative to the nip of the roller assemblies 38, 40 when the plate 52 is appropriately moved in response to the actuation of the cylinders 53 and 54; in a manner to be described. The stop tabs 56 will in one operative mode be in a blocking position relative to the nip for interdicting the leading edge of the sheet being manually fed through the open nip of the in-feed roller assemblies. As a consequence, the leading edge of the media will engage the stop tabs and become de-skewed. A sensor will sense the sheet being aligned and trigger closure of the nip rolls 38 and 40. Thereafter, the tabs 56 are moved to a non-blocking mode for the properly oriented sheet. The in-feed rollers will then, under control of a controller (not shown), feed the leading edge an appropriate amount to the tabber in order to establish the length of the tab portion 26. A sensor (not shown) will determine when the appropriate length to be cut has been reached.

Figure 3:
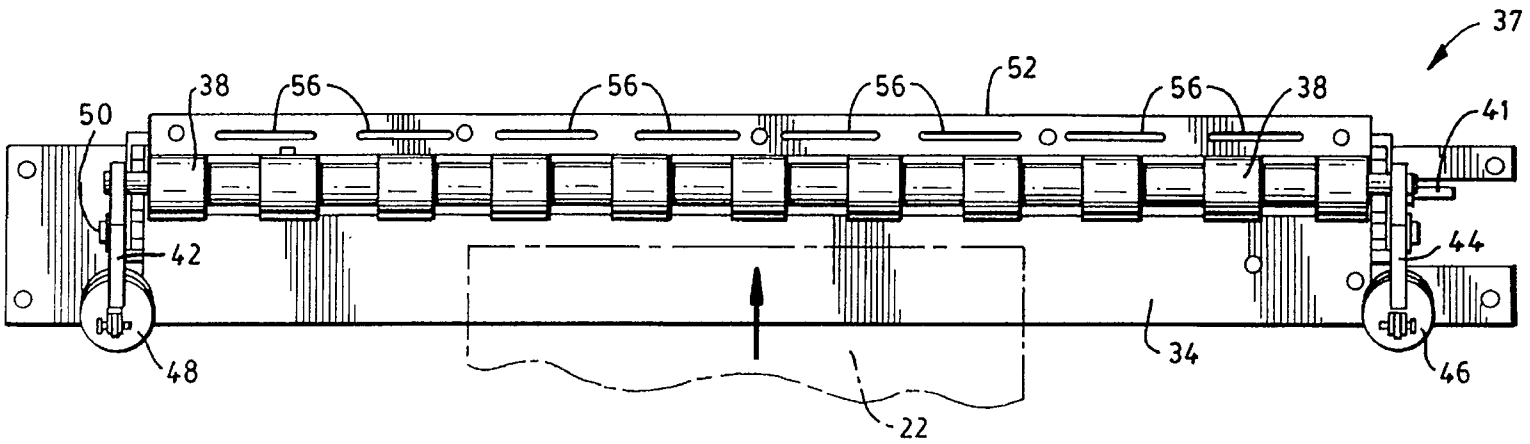
FIG. 3 is a top plan view showing details of the in-feed device of FIG. 2.
Figure 4:
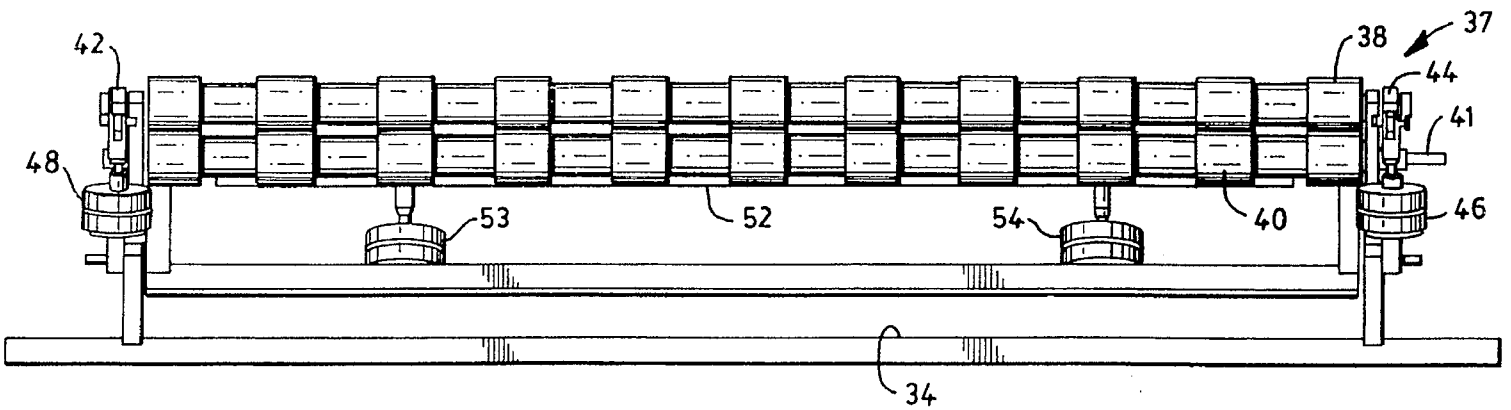
FIG. 4 is a front elevational view showing further details of the in-feed device of FIGS. 2 and 3.
Figure 5:
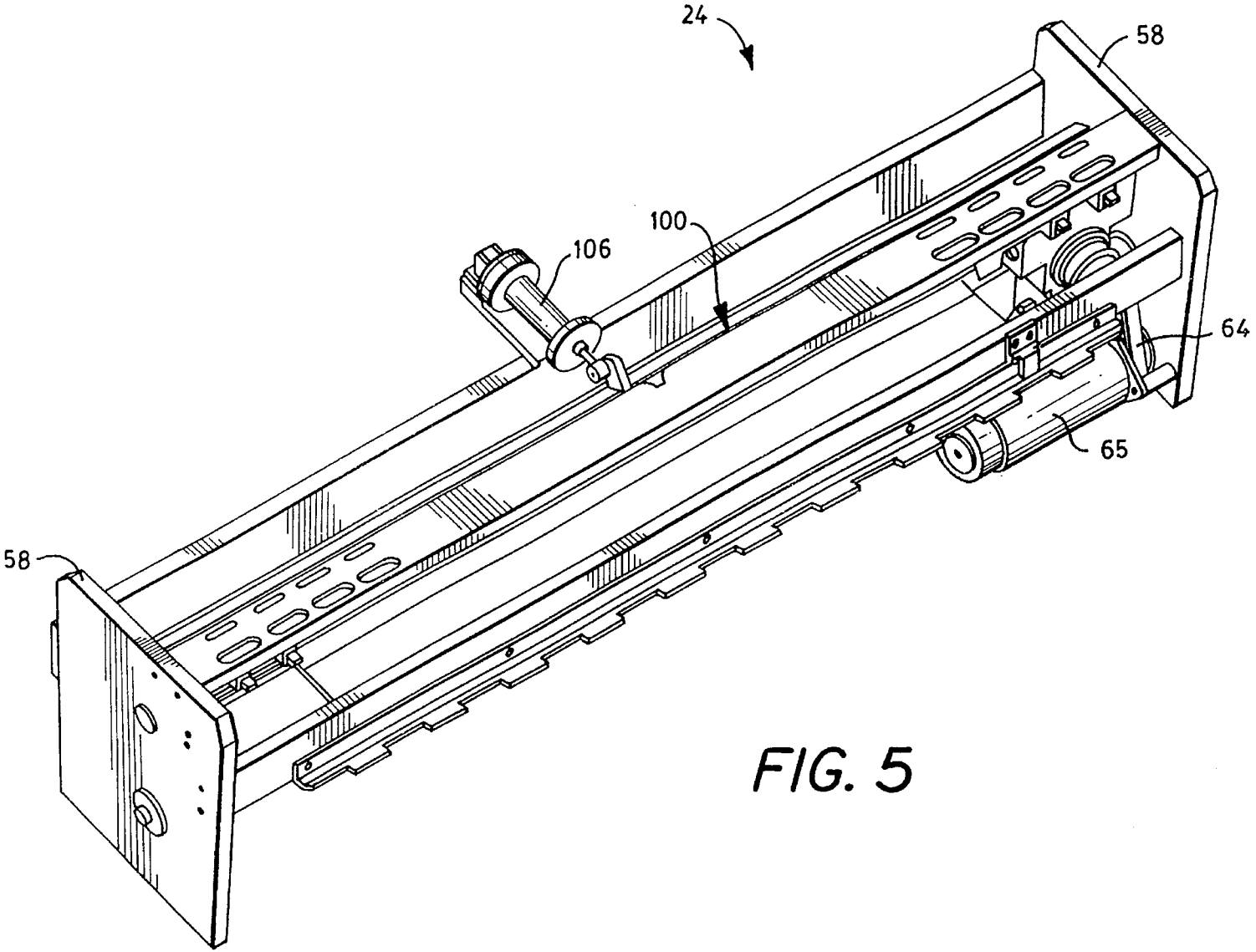
FIG. 5 is a top perspective view showing a tabber device employed in the apparatus of FIG. 1.
Figure 6:
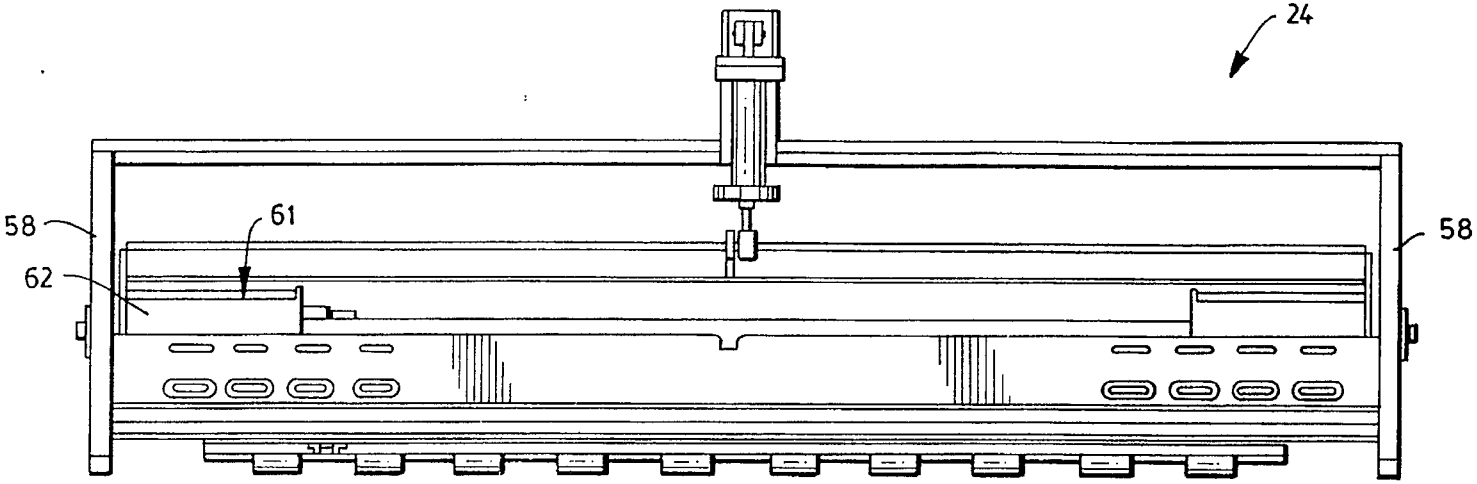
FIG. 6 is a top plan view showing details of the device of FIG. 5.
Figure 7:
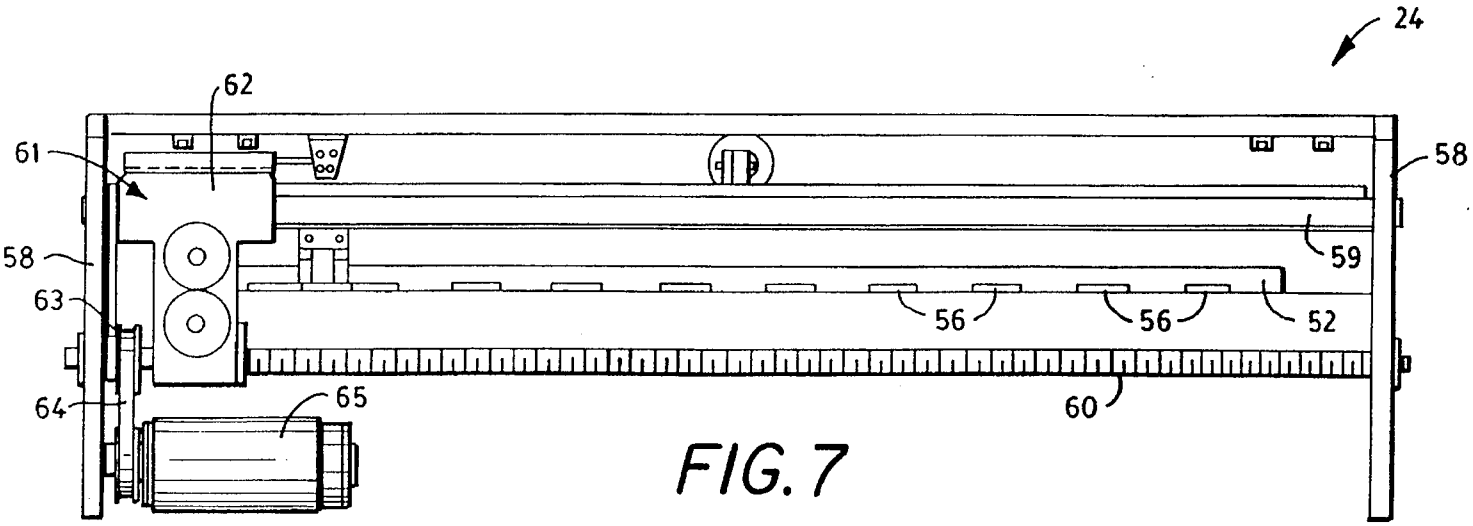
FIG. 7 is a front elevational view showing further details of the device of FIGS. 5 and 6.

Referring now to FIGS. 5–7, the tabber apparatus 24 is shown to include a frame subassembly having spaced apart and upstanding frame plates 58 between which is assembled a horizontal shuttle support rod 59 and a rotatable shuttle drive rod 60 of the screw type. A reciprocatable shuttle assembly 61 is provided which includes a shuttle block 62 that is slidably mounted onto the support rod 59 and threadedly engaged with the drive rod 60. In this embodiment, the rotation of the drive rod 60 is effective to drive the shuttle block 62 transversely across the path of the film media 22, as depicted in FIG. 3, between the frame plates 58. For rotating the drive rod 60, there is provided a pulley 63 which is affixed thereto, and is rotatably driven by a belt 64 in either of two directions of rotation by a reversible D.C. drive motor 65 that is mounted to one of the plates 58.

Referring now to FIGS. 8–10, and 13, the shuttle block 62 has mounted thereon in cantilevered and closely spaced apart and generally parallel orientation, a generally cylindrical and rotatable cutting roller 66, and a generally cylindrical and rotatable anvil or backing roller 68 having a cylindrical outer drive surface portion 69 and a cylindrical supporting surface portion 69*a*. As will be described, these two components act to accurately control and cut a sheet of the film media 22 positioned therebetween.

Figure 13:
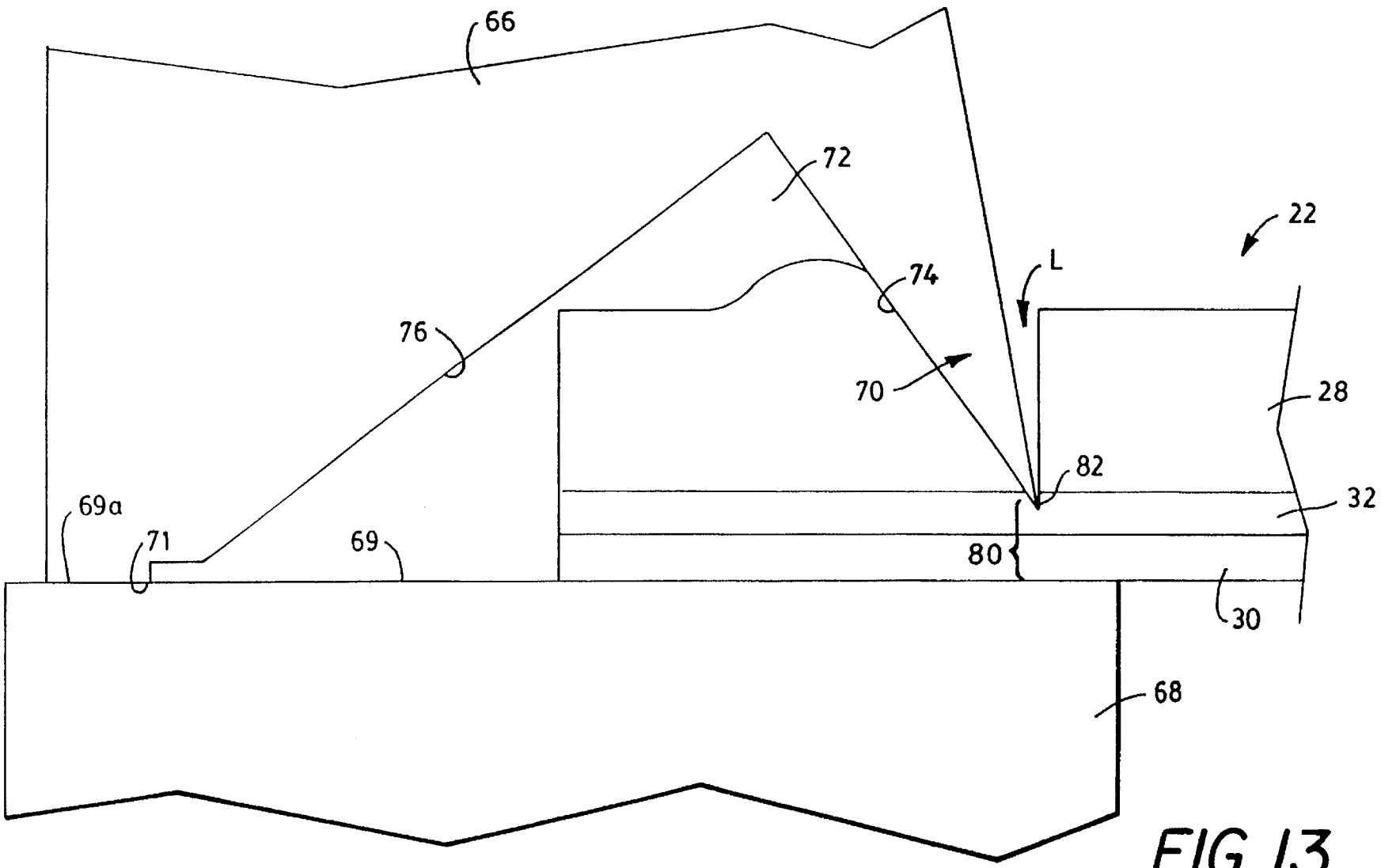

As best shown in FIG. 13, the cutting roller 66 is provided with, preferably, a continuous circular cutting implement 70 made of a suitable cutting material, such as carbide. The cutting implement 70 is formed adjacent one end of the cutting roller 66 and a cylindrical spacer surface 71 formed adjacent an opposite end thereof. Intermediate the spacer surface 71 and the cutting implement 70 is a peripheral depression or relief 72 which is sized and generally configured to displace and receive the waste material which is being cut. Specifically, the peripheral depression 72 is formed by a converging wall 74 of the cutting implement 70 and a wall 76 extending from the spacer surface 71. The spacer surface 71 is in driving frictional engagement with the outer surface 69*a* so that rotation of the backing roller 68 will effect rotation of the cutting roller 66 and hence, a cutting edge 78. In addition, the foregoing engagement between the surfaces 69*a* and 71 serves as a bearer interface which insures the accuracy of the gap 80 above the rotatable backing roller. The gap 80 is the difference in radial dimension between the spacer surface 71 and a circular cutting edge tip 82 of the cutting implement 70 relative to the axis of the roller 66. This gap 80 is fixed and determines and controls the depth of the cut such that the uncut portion of the media 22 remains the same. In the present embodiment, the media 22 has the peel sheet 30 in frictional engagement with the outer surface 69, such that the cutting edge tip 82 will penetrate and cut the keeper sheet 28 to form the tab portion 26. The waste portion of the cutting will enter the peripheral relief 72 and as such enhances a cleaner cutting action.

Rotation of the cutting roller 66, the backing roller 68, and the cutting implement 70 is effected quite simply as the shuttle body traverses along its path between two parked positions located at the ends of the travel. In this regard, there is provided a stationary friction means 84, associated with the frame assembly 34, which directly engages the backing roller 68. Specifically, there is provided an L-shaped bar support 86 extending between the frame plates and which has mounted on an upper surface thereof an angled member having guide flange 88, and a compressible friction strip 90, such as an elastomeric material made of polyurethane and which is retained in a groove longitudinally extending in the bar support. The guide flange 88 assists in guiding a marginal edge of the media 22 between it and opposing surface 89 and beneath the friction strip. The friction strip 90 extends along the length of the bar support 86 for a distance which is beyond the length of travel of the shuttle and is in frictional engagement with the surface 69 of the backing roller 68. Hence, as the shuttle assembly linearly moves, the backing roller 68, which is in engagement with the friction strip 90, rotates. Such rotation is then transferred to the cutting roller 66 because of the frictional engagement therebetween. Of course, the cutting implement 70 is rotated to thereby cut the media 22. Since the movement of the shuttle is linear, the cutting implement will score or cut the marginal edge along a scoring line L of the media sheet 22 to form the tab portion 26. As a consequence, the cutting occurs during shuttle movement in either of two opposite directions of its movement, and without the need to use sensors and the like to control the depth of cutting since the gap relationship is maintained throughout the cutting. Moreover, thickness variations of the media within, of course, the parameters of the spacing accommodations of the cutting and backing rollers will not adversely affect the accuracy of the uncut portion. In addition, the friction strip serves to physically retain the media sheet 22 in a non-buckled position during cutting. This has the advantage of further insuring the cleanness of the cutting action without the sheet being distorted in a manner which will affect the accuracy of the cut.

Figure 8:
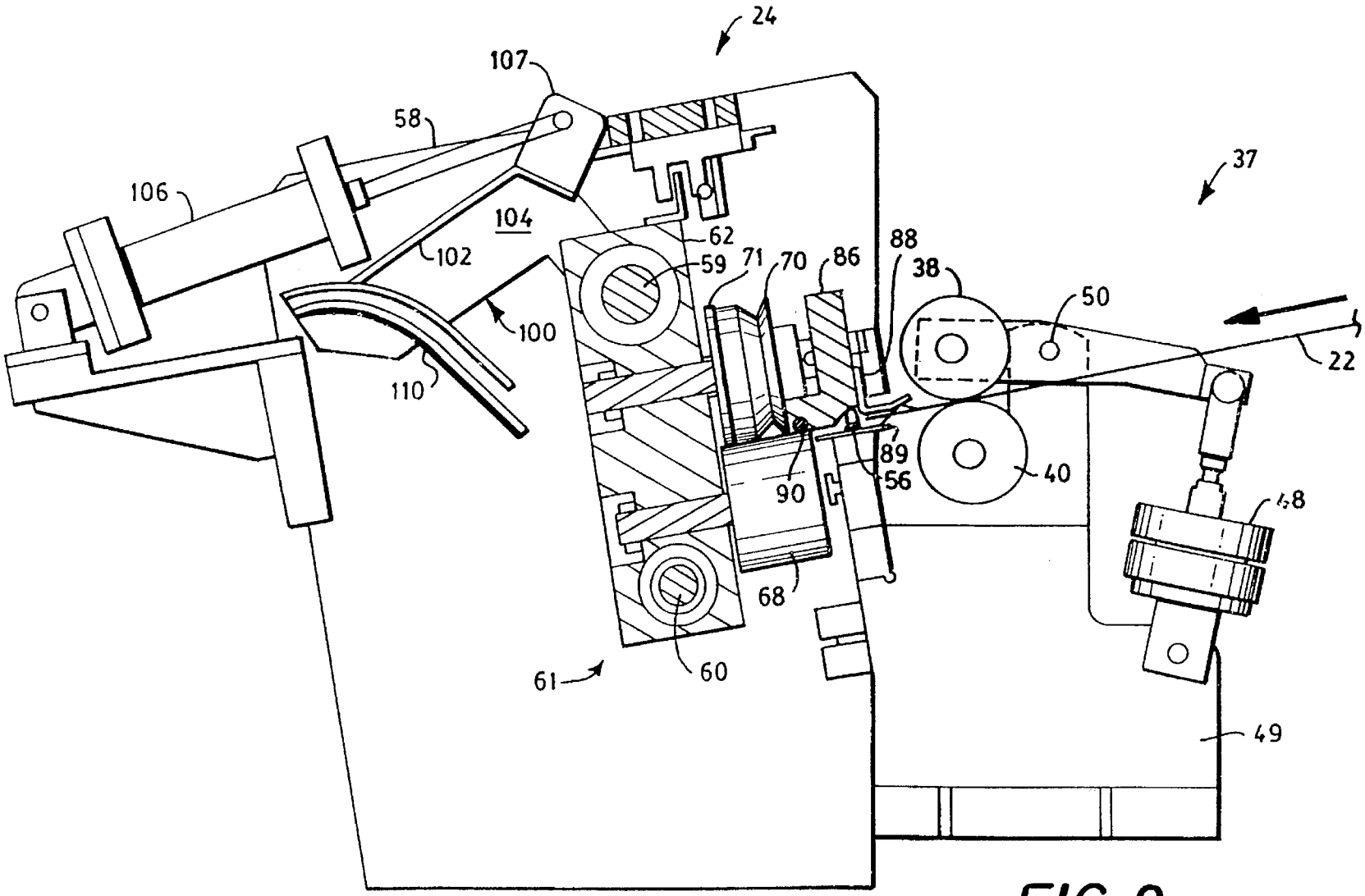
FIG. 8 is a side elevational view partially in section showing the in-feed device of FIGS. 2 through 4 and the tabber device of FIGS. 5 through 8 during an operational step in the processing of a thin laminate sheet.
Figure 9:
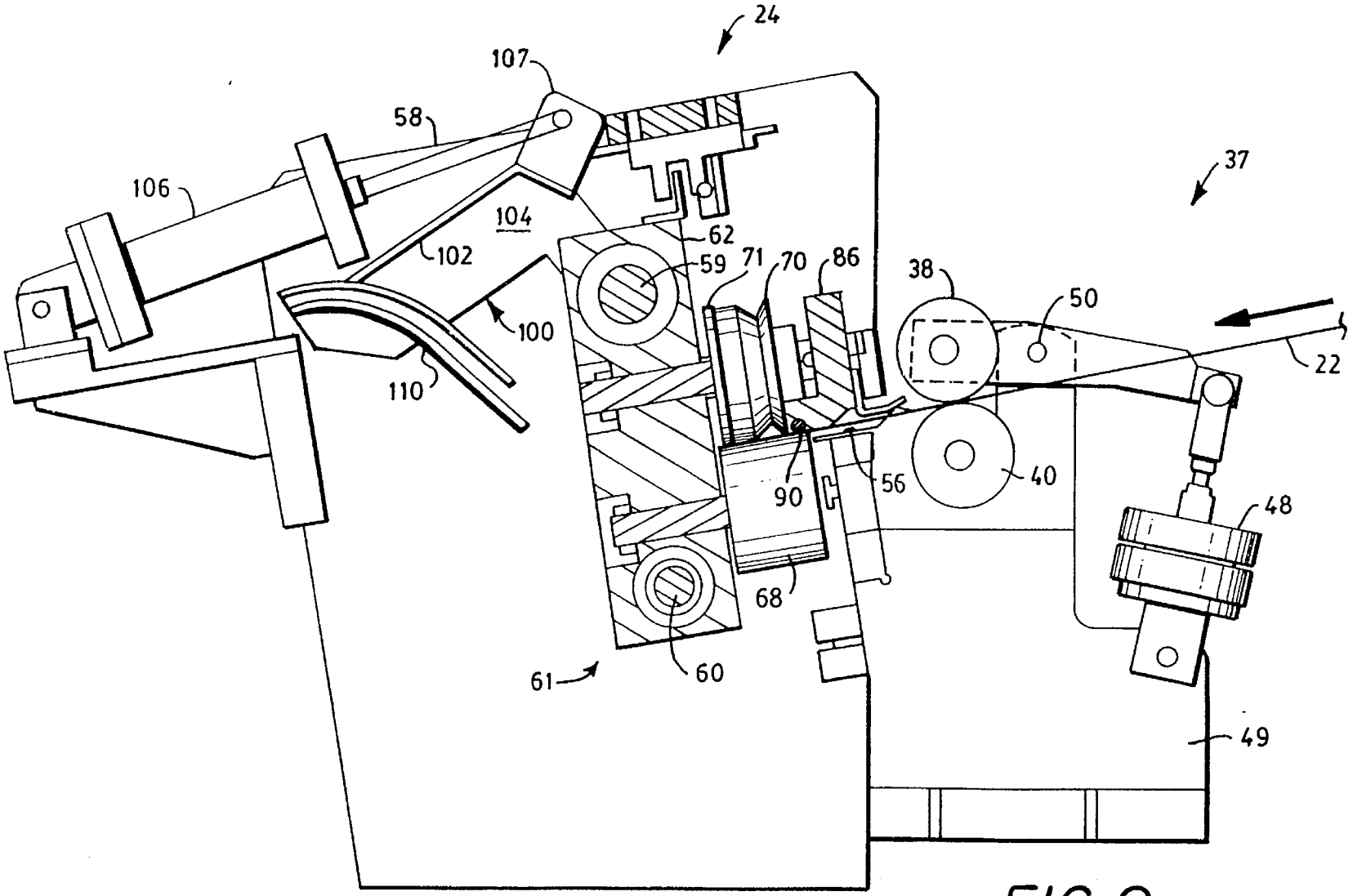
FIG. 9 is a side elevational view, similar to FIG. 8 showing a further operational step in the processing.
Figure 10:
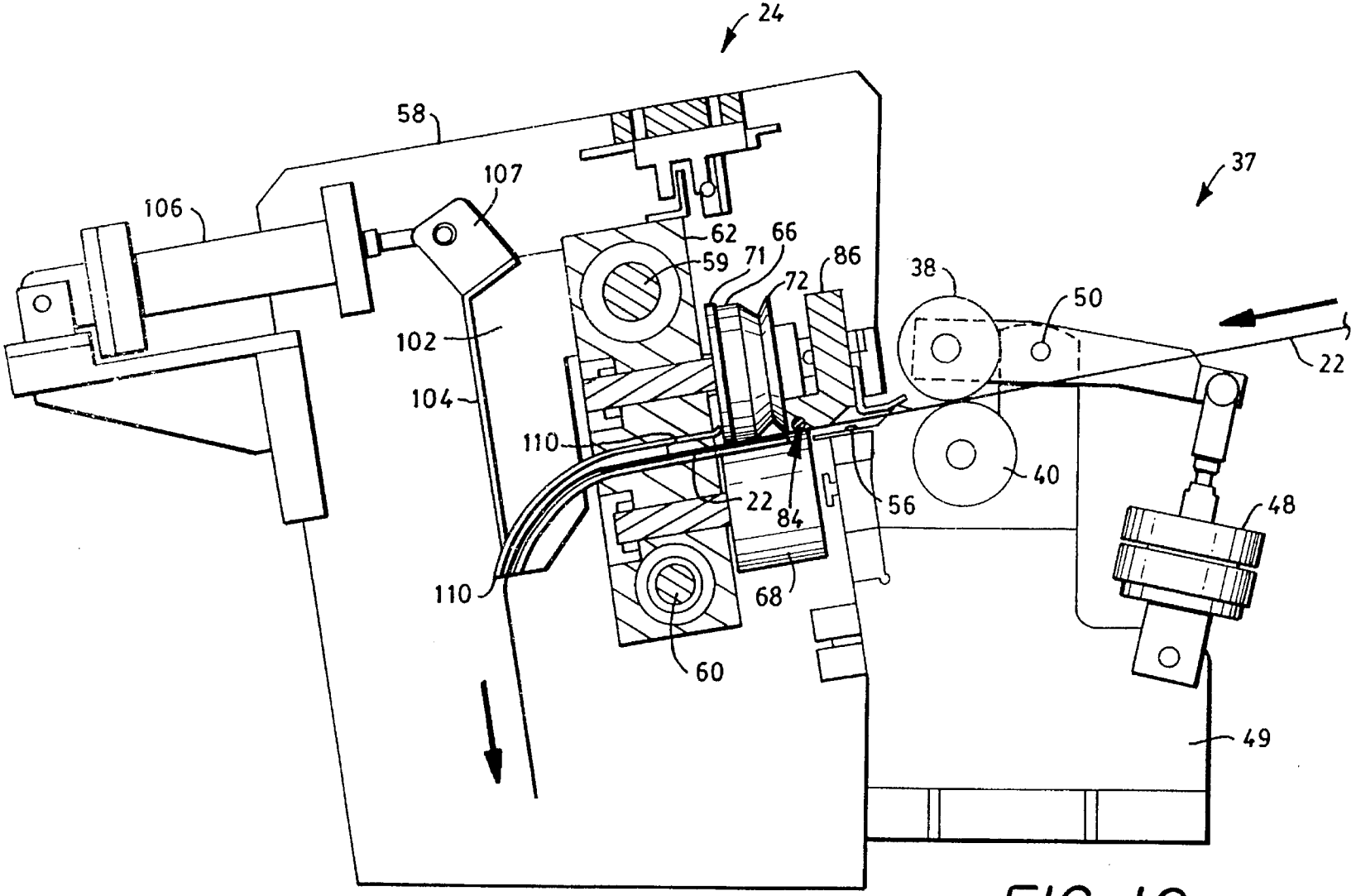
FIG. 10 is a side elevational view, similar to FIGS. 8 and 9 showing a final step in the tabbing operation.

Still referring to FIGS. 8, 9 and 10, in operation the media sheet 22 is fed into the apparatus 20 and between the in-feed rollers 38 and 40 at which time the cylinders 46 and 48 are in a position to maintain the rollers 38 and 40 out of contact. Further, the cylinders 53 and 54 are in the activated position wherein the stop tabs 56 are in the upwardmost position such that the forward edge of the media sheet contacts the tabs and is aligned along a path parallel to that of movement of the shuttle block assembly. A control circuit (not shown) containing an encoder senses that the sheet is in position. The cylinders 46 and 48 are activated to bring the feed rollers 38 and 40 into contact with the media sheet. The tabs 56 are lowered by action of the cylinders 53 and 54. The rollers 38 and 40 then move the media sheet a predetermined distance past the path of the shuttle block assembly 61, by the predetermined distance which was calculated as the amount of tab required at the forward edge of the media sheet. During movement of the media sheet from the position shown in FIG. 8 to that in FIG. 9, the shuttle block assembly 61 is disposed at either of its extreme locations along the support rod 59, out of the path of the media sheet and the media sheet passes under the guide flange 88 and the frictional strip 90. A sensing device in the operating circuit indicates that the media sheet is in place, and the motor 65 is activated to turn the drive rod 60 and move the shuttle block assembly 61 along the support rod 59. The backing roller 68 moves under the media sheet and contacts the friction strip 90 causing the backing roller 68 to rotate, which in turn rotates the cutting roller 66 as the shuttle block assembly 61 moves from one extreme end of the support rod 59 to the other. Thus, the media sheet is scored by the cutting edge 70 to a depth which is maintained by contact between the surface 71 and the surface 69, and rotation of the cutting roller 66 and the backing roller 68 is caused only by frictional contact between the surface 69 of the backing roller and the friction strip 90, which contact takes place through the media sheet.

As best seen in FIGS. 5–10, there is provided a support chute assembly 100 for supporting and guiding the tabbed sheet. The bracket has a pair of spaced side brackets 102 and connected therebetween a back support member 104. Each of the side brackets 102 has a boss and bushing therein (not shown) which serve to rotatably support the chute assembly on opposite end portions of the support rod 59. The side brackets 102 are positioned so as to straddle the shuttle block assembly. The chute assembly 100 is movable between an operative position (FIG. 10), and an inoperative position (see FIGS. 8 and 9). For moving the chute assembly 100 between the inoperative and operative positions, there is provided a fluid piston cylinder 106 which is pivotally mounted on the frame and has its piston rod connected to a tab 107 extending upwardly from the chute assembly. The chute assembly 100 can be moved to the operative position, when the shuttle block assembly is in either of its extreme positions. The chute assembly can be located in the non-operative position when the shuttle block assembly is performing the tabbing functions. The air cylinder 106 maintains the support chute assembly 100 out of the path of the shuttle block assembly 61 during the tabbing process, as shown in FIGS. 8 and 9. With the completion of the tabbing, and the shuttle block assembly 61 disposed at either extremity adjacent the end of the support rod 59 in the noted parked positions, the air cylinder 106 is actuated to bring the support chute assembly 100 downwardly to the position shown in FIG. 10. In this position, the chute assembly 100 is positioned adjacent a leading edge of the scored media and the sheet 22 is fed by actuation of the rollers 38 and 40 through a downwardly and arcuate slotted opening in a transversely extending guide 110 formed as part of the support chute assembly 100. The support chute assembly 100 directs the sheet 22 downwardly through pairs of nip feed roller sets (not shown) to a peeler station for subsequent processing.

After having described the above-entitled construction, the operation thereof is believed to be self-evident. Although a specific and preferred method and apparatus of the present invention has been shown and described above, other variations of the present invention will become apparent to those skilled in the art. The scope of the invention is therefore not limited to the specific forms shown and described, but rather indicated by the claims appended hereto.

What is claimed is:

1. Apparatus for cutting material along a portion of a sheet of material, said apparatus comprising:

a housing assembly;

a carriage assembly movably mounted on said housing assembly and being operable for movement along a travel path;

cutting means mounted on said carriage assembly and having at least a rotatable cutting edge disposed for cutting across one surface of the sheet as said edge travels along a cutting path so as to cut the material in response to said carriage assembly being moved along said travel path;

rotatable supporting means rotatably mounted on said carriage assembly adjacent said cutting means and having a supporting surface for movement across an opposite surface of the sheet when said carriage assembly is moved along said travel path;

said cutting edge being disposed at a predetermined distance from said rotatable supporting means surface for defining a cutting depth of the sheet such that an uncut portion of a sheet being cut has the same dimension as other uncut portions of a sheet being cut regardless of the thickness of sheet being cut;

said cutting means having a bearing surface disposed thereon, and said rotatable supporting means having a bearing surface disposed thereon, both bearing surfaces being in contact one with the other during movement of said carriage assembly along said travel path for maintaining said cutting edge relative to said supporting surface for controlling depth of cut; and, means for moving said carriage assembly along said travel path, whereby the sheet is cut by said cutting edge, wherein said cutting means and said rotatable supporting means are rotatable during movement of said carriage assembly.

2. An apparatus for forming a frangible tab at a marginal edge of a thin laminated sheet of material by scoring adjacent a marginal edge thereof, said apparatus comprising:

a frame assembly;

a shuttle assembly mounted on said frame assembly and being movable along a path to a marginal edge of the sheet;

a cutting roller assembly rotatably mounted on said shuttle assembly and having at least a cutting edge disposed for movement across one surface of the sheet when said shuttle assembly is moved along said path;

a backing roller assembly rotatably mounted on said shuttle assembly adjacent said cutting roller assembly and having a supporting surface for movement across an opposite surface of the sheet when said shuttle assembly is moved along said path;

means for frictionally contacting one surface of the sheet and retaining the sheet in contact with said backing roller assembly during movement of said shuttle assembly along said path;

said cutter roller assembly having a bearing surface disposed thereon, and said backing roller assembly having a bearing surface disposed thereon, both bearing surfaces being in contact one with the other during movement of said shuttle assembly along said path for maintaining said cutting edge relative to said supporting surface thereby controlling depth of cut, and for effecting driving rotation of said cutter roller assembly in response to rotation of said backing roller assembly;

means for moving said shuttle assembly along said path whereby at least one layer of the laminate is cut by said cutting edge and wherein each of said cutting and backing roller assemblies is rotatable during movement of said shuttle assembly by the frictional engagement between said backing roller assembly and said friction means and the engagement of both bearing surfaces of said roller assemblies.

3. The apparatus of claim 2 wherein said cutting roller comprises the cutting edge spaced from, and in alignment with said backing roller surface.

4. The apparatus of claim 2 wherein said cutting roller comprises the cutting edge spaced adjacent a peripheral depression which is configured for directing waste from a cutting action.

5. The apparatus of claim 4 which further includes means on said frame assembly for guiding a leading marginal edge of the sheet between said cutting edge and said rotatable supporting surface.

6. The apparatus of claim 5 wherein said means for guiding the leading marginal edge of the sheet includes a pair of in-feed rollers disposed for receiving the marginal edge therebetween and feeding it to a position in said path of said shuttle assembly.

7. The apparatus of claim 6 which further includes means for alignment of the marginal edge of the sheet with said path of said shuttle assembly, said alignment means is disposed between said path of said shuttle assembly and said pair of in-feed rollers for deskewing the marginal edge which contacts said alignment means.

8. The apparatus of claim 2 which further includes means for alignment of a leading marginal edge of the sheet with said path of said shuttle assembly, said alignment means disposed upstream of said cutting means.

9. The apparatus of claim 2 wherein said cutting roller and backup roller assemblies are in generally parallel relationship to each other and are in cantilevered relationship to said shuttle assembly.

10. The apparatus of claim 2 wherein said friction means is an elongated strip of friction material mounted on an elongated body on said frame assembly, said strip extends in a direction generally parallel to said path, whereby said friction material effects rotation of said backing roller assembly which in turn effects rotation of said cutting roller assembly.

11. The apparatus of claim 2 further including a sheet support and guiding means mounted on said frame assembly and in operative relationship with said cutting and backup roller assemblies, and being movable between operative and inoperative positions, wherein when in said operative position, said sheet support and guiding means is positioned for receiving the cut marginal edge of a cut sheet and for guiding the cut sheet to another operative station.

* * * * *